US006223460B1

(12) United States Patent
Schmitter et al.

(10) Patent No.: US 6,223,460 B1
(45) Date of Patent: May 1, 2001

(54) TRIGGER SAFETY

(76) Inventors: Edward P. Schmitter, 1631 Fulmer Rd., Blythewood, SC (US) 29016; Zdenek Prisovsky, 257 Morgan Avenue, Kitchener, Ontario N2A 2M7 (CA); Gary A. Sniezak, 517 Paces Run Ct., Columbia, SC (US) 29223; Frank A. Spaniel, 117 Riverbirch Rd., Lexington, SC (US) 29072

( * ) Notice: Subject to any disclaimer, the term of this patent is extended or adjusted under 35 U.S.C. 154(b) by 0 days.

(21) Appl. No.: 09/299,777

(22) Filed: Apr. 26, 1999

(51) Int. Cl.[7] ..... F41A 17/00
(52) U.S. Cl. ..... 42/70.06
(58) Field of Search ..... 42/70.06, 70.07, 42/70.11

(56) References Cited

U.S. PATENT DOCUMENTS

| | | | | |
|---|---|---|---|---|
| 707,925 | * | 8/1902 | Herndon | 42/70.06 |
| 2,401,482 | * | 6/1946 | Hendey | 42/70.06 |
| 2,490,922 | | 12/1949 | Rutherford et al. . | |
| 2,635,380 | | 4/1953 | Baker et al. . | |
| 2,657,490 | | 11/1953 | Browning . | |
| 2,711,043 | | 6/1955 | Bent, Jr. . | |
| 2,856,718 | | 10/1958 | Fischer . | |
| 3,324,587 | | 6/1967 | Bryan . | |
| 3,711,979 | | 1/1973 | Small . | |
| 3,713,239 | | 1/1973 | Sperling . | |
| 3,715,826 | | 2/1973 | Seifried . | |
| 3,732,641 | | 5/1973 | Adajian . | |
| 3,978,604 | | 9/1976 | Smith . | |
| 4,067,132 | | 1/1978 | Smith . | |
| 4,677,781 | | 7/1987 | Lee . | |
| 4,719,713 | * | 1/1988 | Hagle | 42/1.01 |
| 4,754,568 | * | 7/1988 | Brandt | 42/70.06 |
| 5,025,582 | | 6/1991 | Mote, Sr. . | |
| 5,033,218 | | 7/1991 | Nelson . | |
| 5,355,768 | * | 10/1994 | Felk | 89/147 |
| 5,402,593 | | 4/1995 | Lenkarski et al. . | |
| 5,724,760 | | 3/1998 | Langner . | |
| 5,778,587 | | 7/1998 | Brandl et al. . | |
| 5,799,434 | | 9/1998 | Krieger et al. . | |

FOREIGN PATENT DOCUMENTS

| | | | | |
|---|---|---|---|---|
| 004303333 | * | 6/1994 | (DE) | 42/70.11 |

* cited by examiner

*Primary Examiner*—Michael J. Carone
*Assistant Examiner*—Denise J. Buchley
(74) *Attorney, Agent, or Firm*—Michael A. Mann; Nexsen Pruet Jacobs & Pollard LLC

(57) ABSTRACT

A trigger safety for a pistol includes a laterally slidable plug incorporated into the trigger that, when slid laterally to extend beyond the confines of the trigger, will prevent rearward movement of the trigger by the plug's interference with the pistol frame. A spring internal to the trigger, imparts a force on plug to retain it positioned in either the safety position or the fire position and resist movement. The plug can be reversed for left-handed users so that the pistol can be placed in a "safe" or a "fire" position with the trigger finger of either hand.

13 Claims, 5 Drawing Sheets

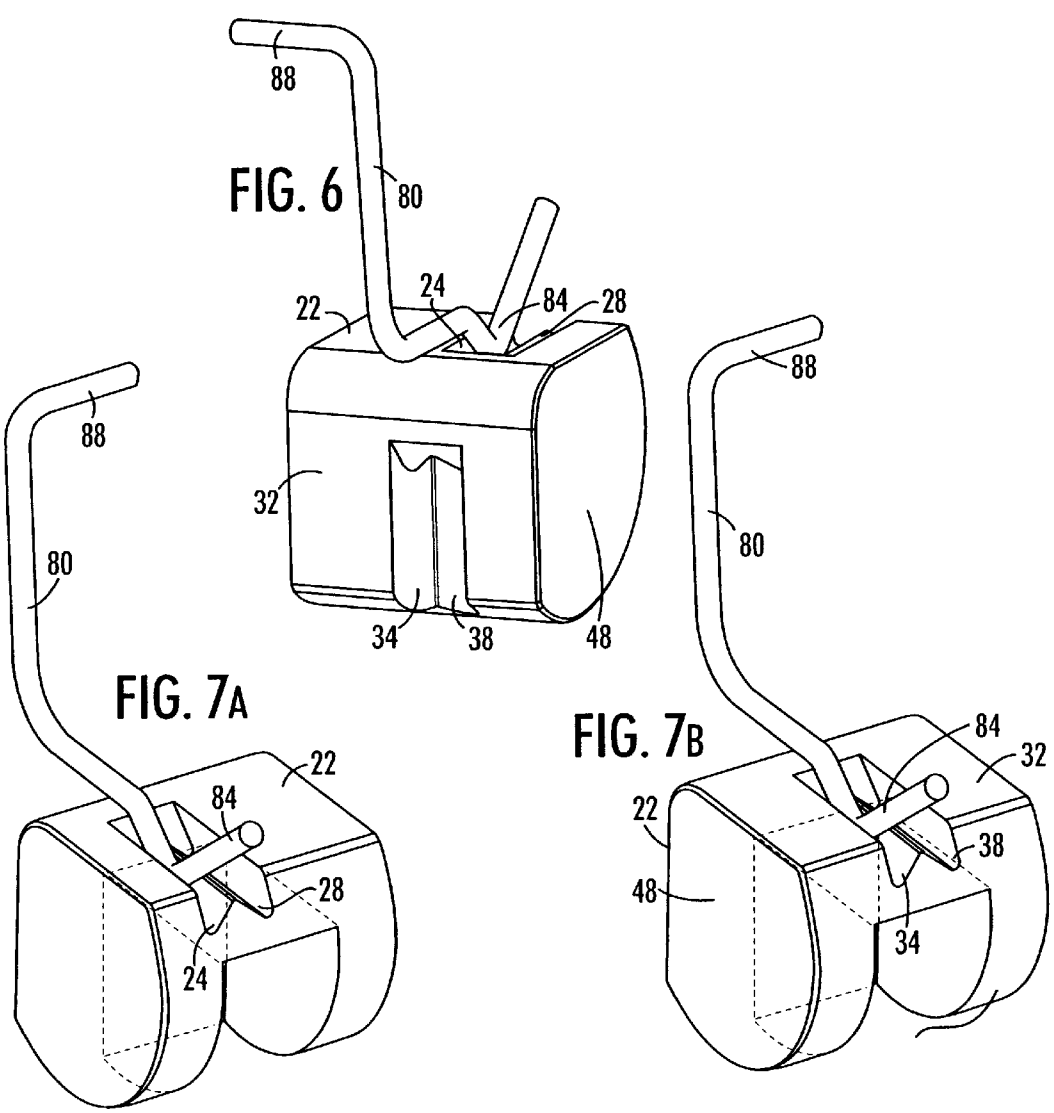
FIG. 6
FIG. 7B
FIG. 7A
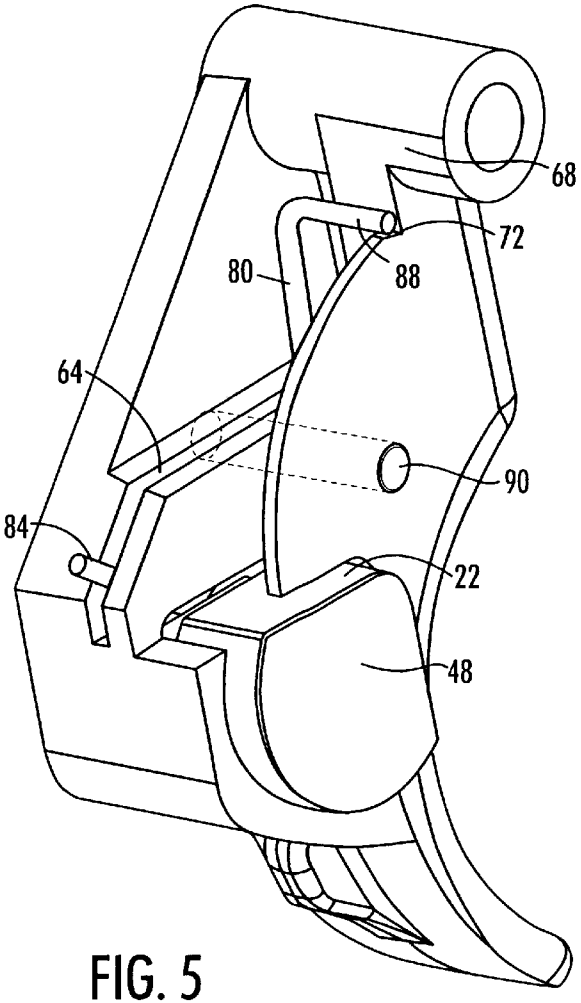
FIG. 5

TRIGGER SAFETY

BACKGROUND OF THE INVENTION

1. Field of the Invention

The present invention relates to safety mechanisms for firearms and particularly to a trigger safety mechanism.

2. Discussion of Background

Due to the potential risks of serious bodily injury or death, firearms must be handled carefully. Each year, numerous people die from the accidental discharge of a firearm. In order to prevent accidental discharge, all firearms come equipped with at least one safety mechanism. If the safety mechanism is engaged, the firearm will be incapable of firing, even if a round is in the chamber.

Although safeties play an important role in preventing accidental discharge of a pistol, a safety must sometimes be capable of quick disengagement. If the pistol is used in a military operation or by law enforcement, the speed in which the safety can be disengaged may be a matter of life or death. While less critical, a hunter may also miss a clean shot if the safety cannot be disengaged quickly.

Often safety mechanisms will be located on either the left or the right side of a firearm. When the user is left-handed, a safety designed for right-handers will either be awkward or will need to be reversed to accommodate the left-hander.

Safety mechanisms for pistols have been used for over a century. Typically, a button or lever on the exterior of the frame of a firearm is pressed with the user's thumb to engage the safety. The action of pressing the button disables an internal part of the pistol, such as the sear or trigger arm, so that the pistol is incapable of firing. Unfortunately, manipulation of an external safety that operates on internal components does not allow a user to verify that the pistol is actually incapable of firing without pulling the trigger. Moreover, the safety's interaction with these internal components is subject to failure so that a pistol with the safety in the off position might not fire if the safety failed.

Therefore, there is a need for a safety device which operates in a way that the user can verify that it will or will not prevent the firearm from firing without pulling the trigger and can be easily operated with the trigger finger of either hand.

SUMMARY OF THE INVENTION

According to its major aspects and broadly stated, the present invention is a trigger safety for a pistol that is integrally formed in the trigger so that a user can operate the safety with the trigger finger, regardless of whether the user is left-handed or right-handed. Instead of manipulating internal parts of the pistol, the trigger safety prevents movement of the trigger by the plug's interference with the frame of the pistol. The safety comprises a trigger having a plug slidably received therein so that the plug can be moved laterally between a firing position where the plug allows movement of the trigger and a safety position where the plug prevents movement of the trigger. A spring internal to the trigger, imparts a force on the plug to retain the plug's position where it is placed, regardless of whether it is in the safety position or the fire position and resists movement of the plug. In a safety position, the plug extends outside of the trigger envelope so that the movement of the trigger is blocked by the engagement of the plug with the frame of the pistol; however, in firing position, the plug is entirely confined within the trigger envelope so that the trigger is capable of firing the pistol as usual. The term "envelope" means the cross sectional area defined by outermost dimensions of the trigger when viewed from the front rather than the side of the firearm and which is approximately the same area as that defined by the hole formed in the frame to allow the trigger to be pulled partially into the frame during firing. The safety is in the "off" or firing position when the plug is located within the envelope and in the "on" or safe position when the plug is outside of the envelope to any extent.

A major advantage of the present invention is the ability to operate the safety with the trigger finger of either hand. As a result, the user can control the operation of the safety with a single hand and does not need to bring a non-firing hand to the firearm to take the safety off or put it on. As a result, the safety can be disengaged much more easily and subtly.

The simplicity of the design is another important advantage of the present invention. The manufacturing costs are significantly reduced as a result of the simplicity of the design. Since the safety does not interact with any internal components of the pistol, it is less likely to fail. Furthermore, unlike the safety mechanisms that disengage internal components not visible to the user, the user can see the operation of the present safety and know that it either will or will not prevent firing.

Still another feature of the present invention is the spring bias that urges the plug to remain where it is placed and resist movement, either in the fire position or in the safe position, regardless of the direction the plug is moved. Moreover, the grooves that engage the detent end of the spring provide resistance to movement between the fire position and the safety position.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 5 is a right rear detailed view of a trigger with the trigger safety in the safe position and configured for a right-handed user, according to a preferred embodiment of the present invention;

FIG. 6 is a front detailed view of the plug and spring with the trigger safety in the fire position and configured for a right-handed user, according to a preferred embodiment of the present invention;

FIG. 7A is a rear detailed view of the plug and spring with the trigger safety in the safe position and configured for a right-handed user, according to a preferred embodiment of the present invention;

FIG. 7B is a rear detailed view of the plug and spring with the trigger safety in the fire position and configured for a left-handed user, according to a preferred embodiment of present invention.

DETAILED DESCRIPTION OF A PREFERRED EMBODIMENT

Figure 1:
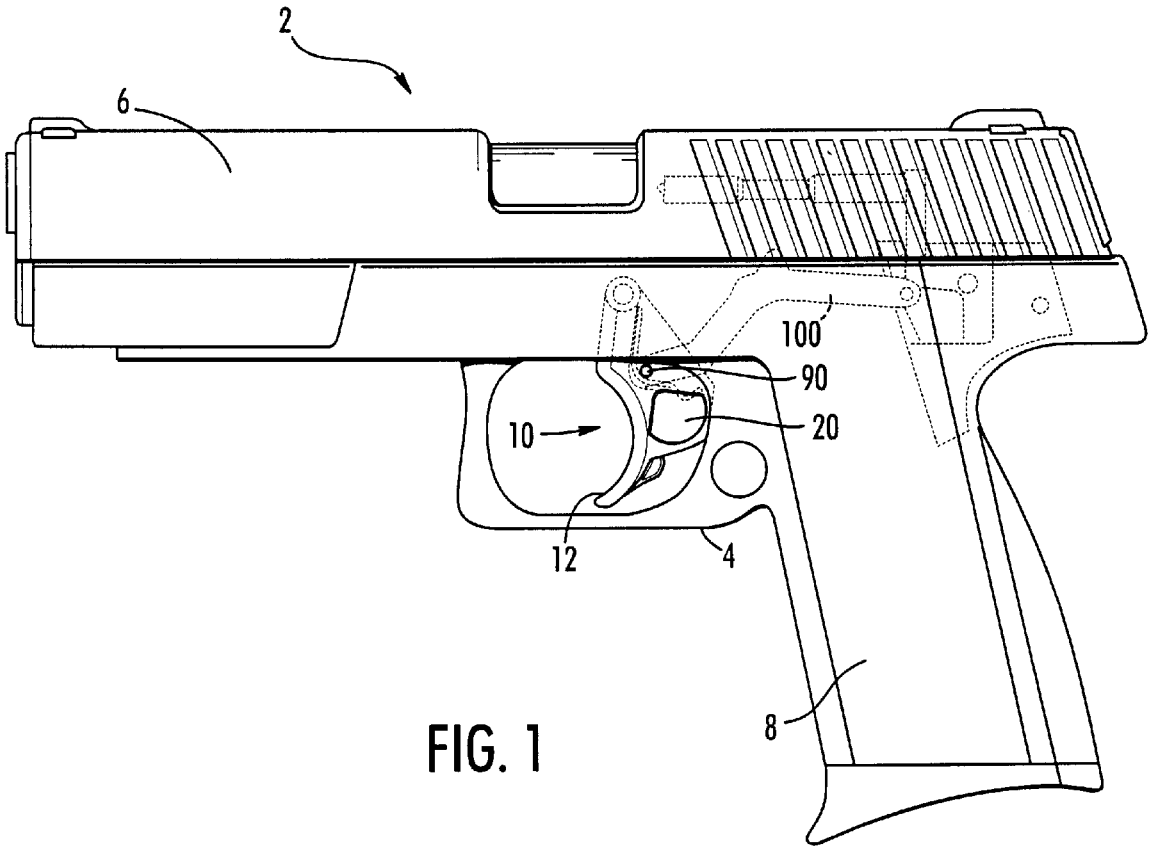
FIG. 1 is a left side view of a pistol having the trigger safety, according to a preferred embodiment of the present invention.
Figure 2A:
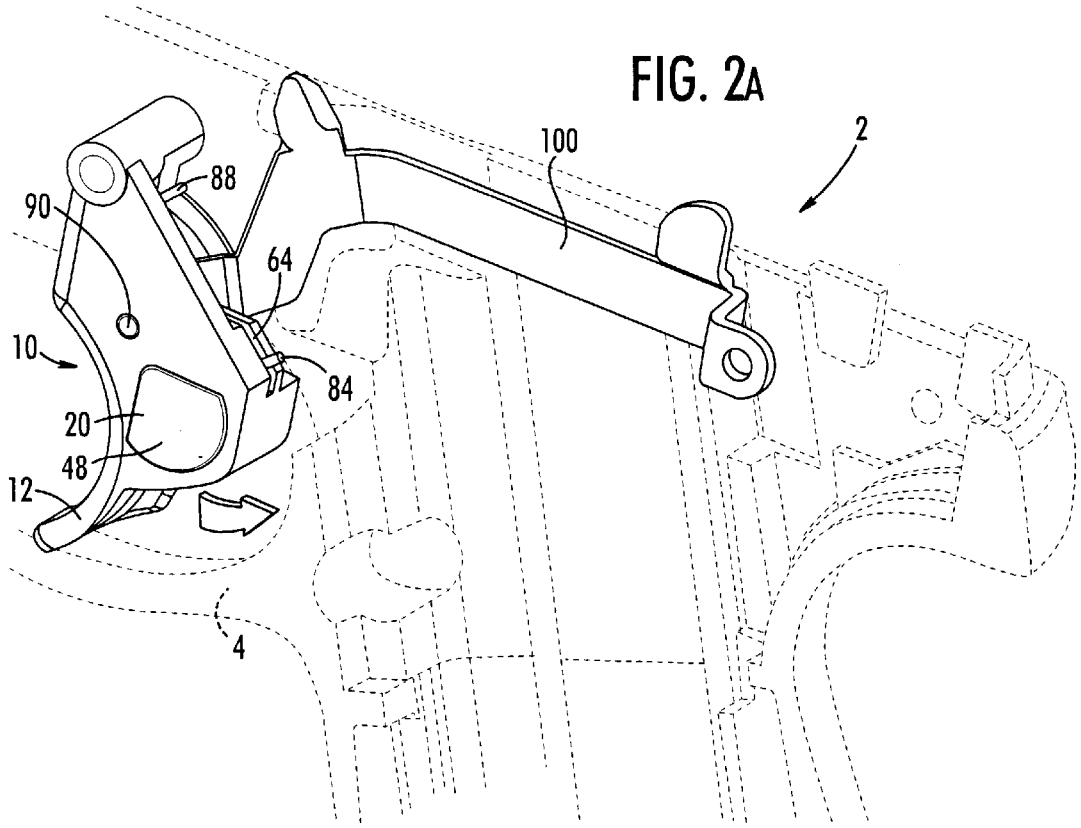
FIG. 2A is a left perspective view of the trigger safety configured for a right-handed user that is in a fire position with the trigger attached to a trigger bar and the pistol in ghost, according to a preferred embodiment of the present invention.
Figure 2B:
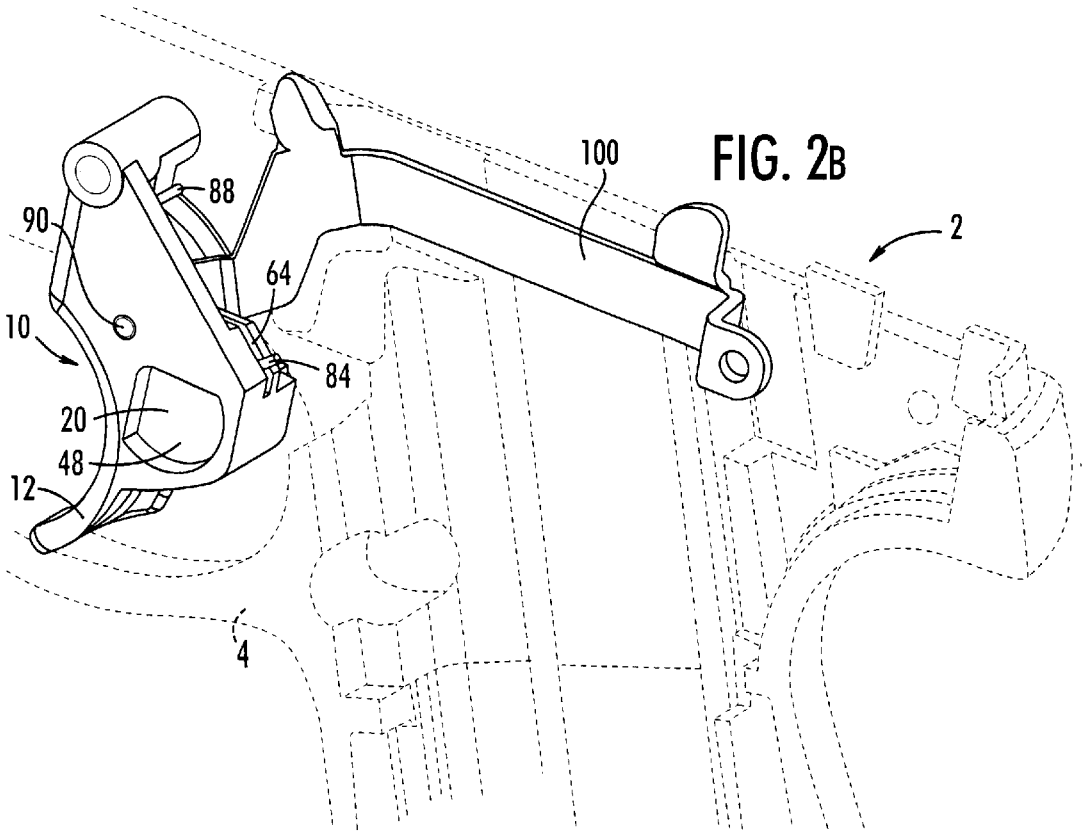
FIG. 2B is a left perspective view of the trigger safety configured for a right-handed user that is in a safety position with the trigger attached to a trigger bar and the pistol in ghost, according to a preferred embodiment of the present invention.

Referring now to the figures, the present invention is a trigger safety for a pistol. The safety, generally referred to by reference number 10, comprises a trigger 12 having a plug 20 slidably received therein so that plug 20 can be moved laterally between a fire position that allows movement of trigger as illustrated in FIG. 2A and a safe position that prevents movement of trigger as illustrated in FIG. 2B. The term "laterally" means orthogonal to the direction trigger 12 is moved to fire pistol 2. In a safe position, plug 20 laterally extends outside the trigger envelope so that the movement of trigger 12 is blocked by the engagement of plug 20 with the frame 4 of the pistol 2; however, in a fire position, plug 20 is within trigger envelope so that trigger 12 is capable of firing pistol 2. By the term envelope, it is meant the maximum cross sectional area defined by the outermost surface of trigger when viewed from the front of the firearm. Plug 20 is within the envelope when plug 20 is held entirely within aperture 60; while plug 20 is not within envelope if any portion of plug 20 protrudes from aperture 60 and thereby prevents trigger 12 from being pulled because it will engage with the frame 4 and interfere with relative movement of trigger 12 and frame 4. Since the engagement of plug with the frame of the pistol blocks movement of the trigger, preferably safety 10 is used on a double-action pistol. Unlike single-action pistols that have a small trigger movement to fire, a double-action pistol would have better engagement with plug 20 to block movement of trigger prior to firing. The term double-action is a pistol that both cocks and fires with a single pull of the trigger.

In terms of orientation, safety 10 has a front end near the barrel 6 of pistol 2 and an opposing rear end near the grip 8 of pistol 2. The left and opposing right side of safety 10 can be viewed from the rear of pistol 2. In other words, the trigger finger of a left-handed user engages the left side of safety 10 while the trigger finger of a right-handed user engages the right side of safety 10.

Figure 3B:
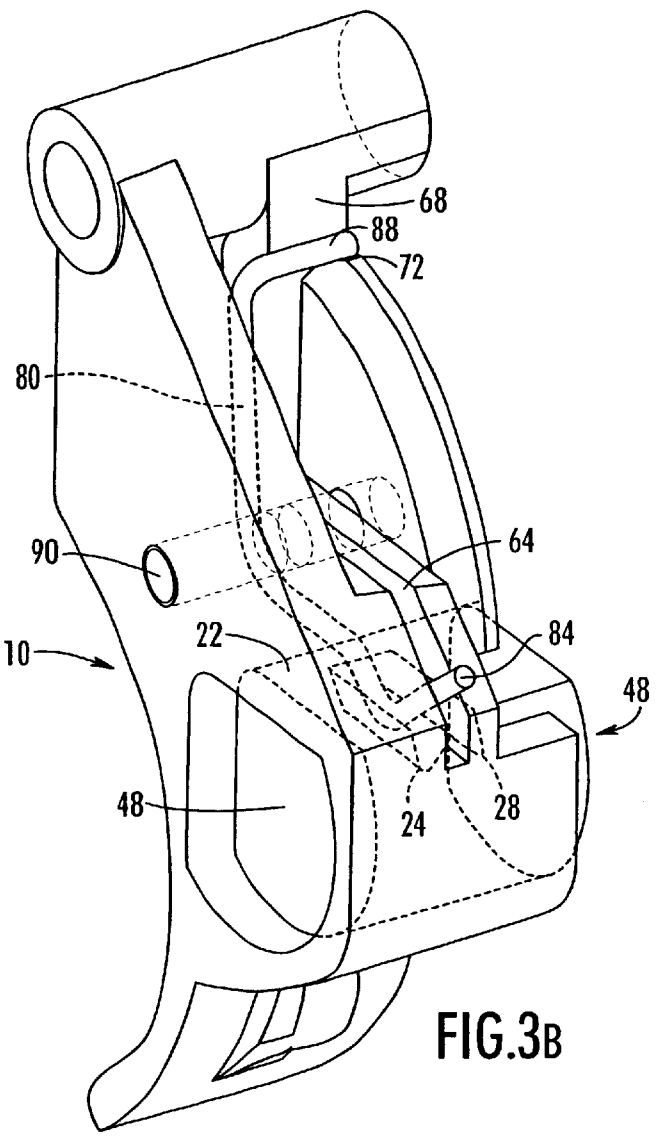
FIG. 3B is a left rear detailed view of the trigger with the trigger safety in a safety position and configured for a right-handed user, according to a preferred embodiment of the present invention.
Figure 4B:
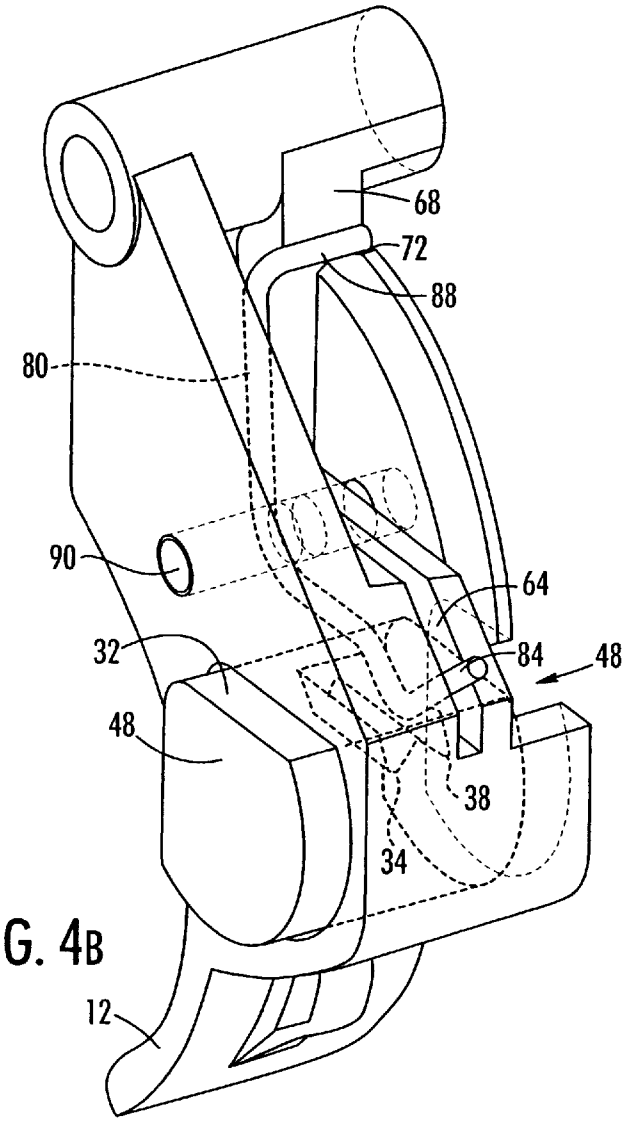
FIG. 4B is a left rear detailed view of the trigger with the trigger safety in a safety position and configured for a left-handed user, according to a preferred embodiment of the present invention.

Trigger 12 has an aperture therethrough of sufficient dimension to slidably receive plug 20. Plug 20 can be moved laterally between a safe position and a fire position by applying a sufficient force on the engagement surface 48 of plug 20 using the trigger finger of the user, regardless of whether the user is left-handed or right-handed. If the user is right-handed, plug 20 may be moved to the safe position by pushing plug 20 to the right as illustrated in FIG. 3B; on the other hand, if the user is left-handed, plug 20 may be moved to the safe position by pushing plug 20 to the left as illustrated in FIG. 4B. In order to disengage safety 10, plug 20 may be pushed with the user's trigger finger so that it does not protrude from trigger envelope. Although plug 20 may be operated by either a right handed or left-handed user, the operation is not symmetric. Rather, the pistol must be configured for a left-hander before the safety will be usable by a left-hander, and vice versa. Because of this, the user need not be concerned that plug 20 will accidentally be pushed through fire position to safe position on the opposite side of trigger 12, if excessive pressure is placed on the movement of plug 20; instead, plug 20 will be retained within aperture. For example, if safety 10 is configured for a right handed user, even if the user pushes his trigger finger on plug 20 with excessive pressure, plug 20 will be forced the into fire position.

Plug 20 has a right-handed surface 22 and a left-handed surface 32 with each having a pair of the grooves. Right-handed surface 22 contains a right-handed safety groove 24 and a right-handed fire groove 28; likewise, left-handed surface 32, perpendicular to right-handed surface 22, contains a left-handed safety groove 34 and a left-handed fire groove 38. A pair of opposing engagement surfaces 48 are positioned on plug 20 so that plug can be easily moved between a safe position and a fire position. Grooves 24, 28, 34, 38 receive the detent end 84 of spring 80 to position plug 20 between a fire position and a safe position. If configured for a right-handed user, right-handed surface 22 is positioned to engage detent end 84 of spring 80; if configured for left-handed user, left-handed surface 32 positioned to engage detent end 84 of spring 80.

Safety 10 can be easily changed between a configuration for a right-handed user to a configuration for a left-handed user. As best illustrated in FIG. 6, plug may be rotated so left-handed surface 32 is positioned to engage detent end 84 of spring 80 as illustrated in FIG. 7B. As will be clear to one of ordinary skill in the art, changing this configuration will be a simple task that any user could easily accomplish without a gunsmith.

Figure 4A:
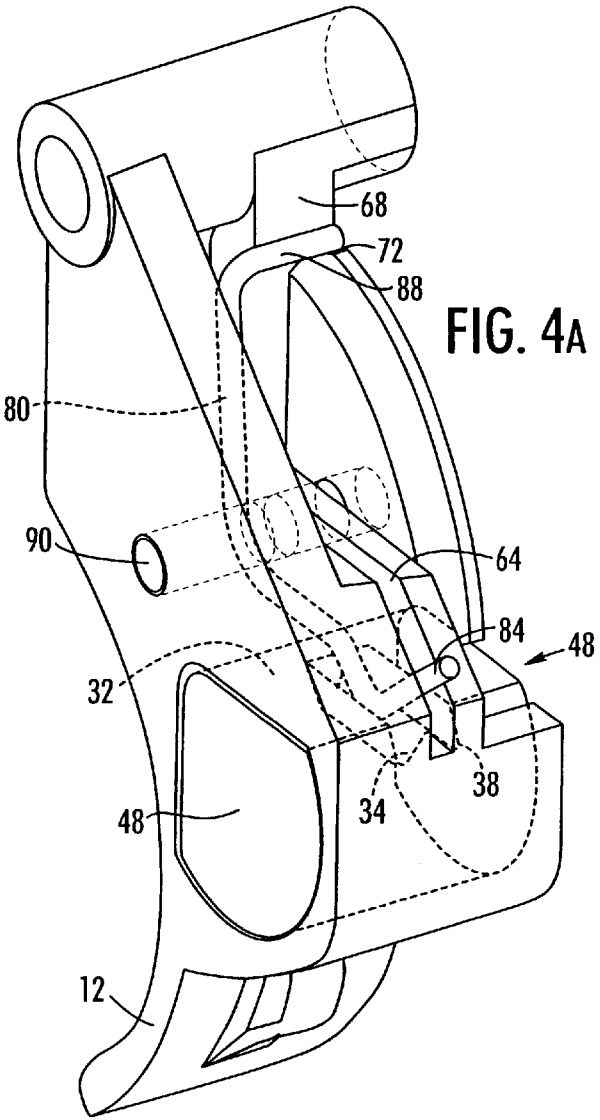
FIG. 4A is a left rear detailed view of the trigger with the trigger safety in a fire position and configured for a left-handed user, according to a preferred embodiment of the present invention.

Spring 80 has a support end 88 and a detent end 84 biased around a pin 90 to provide sufficient pressure on plug 20 to maintain its relative position in the selected fire or safe position. Detent end 84 of spring 80 is a sufficient dimension and shape to be received by a groove 24, 28, 34 or 38 to maintain the selected fire or safety positioning. Support end 88 of spring 80 rests on wall 68 of trigger as best seen in FIG. 4A. Preferably a notch 72 is formed along wall 68 so that spring 80 maintains position within trigger 12. Trigger 12 also has an internal slot 64 to help maintain positioning of spring 80.

Figure 3A:
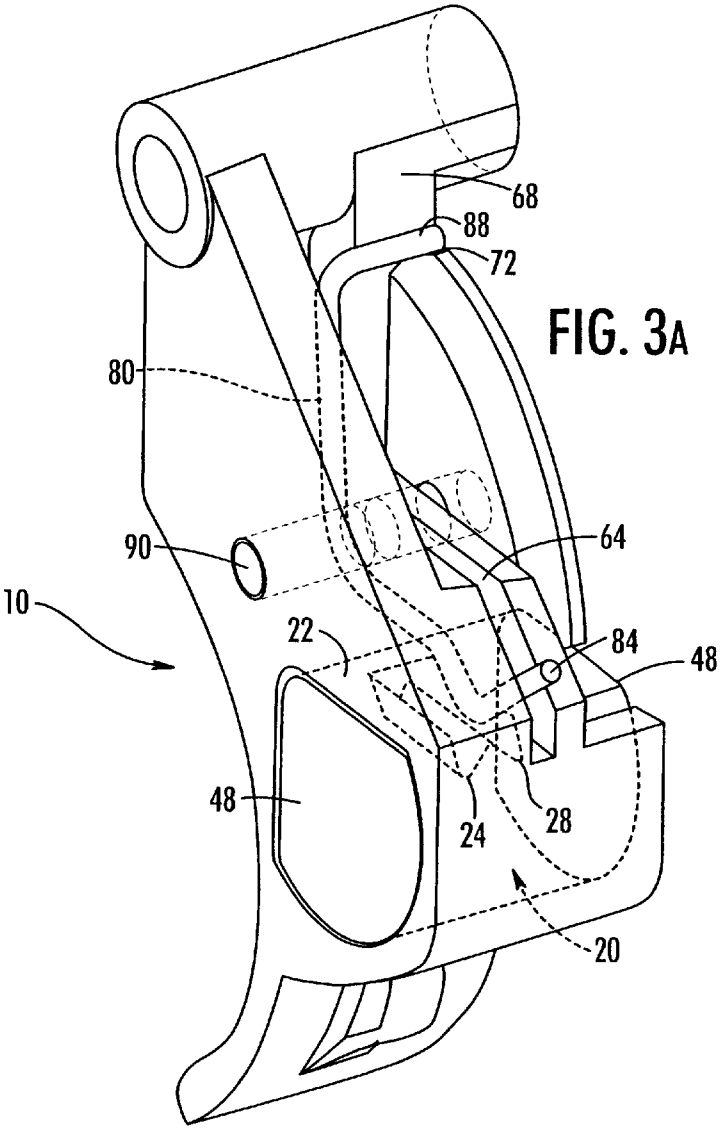
FIG. 3A is a left rear detailed view of the trigger with the trigger safety in a fire position and configured for a right-handed user, according to a preferred embodiment of the present invention.

In operation by a right-handed user, plug 20 is configured with right-handed surface 22 oriented to engage detent end 84 of spring 80 as illustrated in FIG. 7A. In order to place safety 10 in a safe position, wherein the pistol 2 is incapable of firing, push the plug 20 to the right as illustrated in FIG. 3B. In the safe position, detent end 84 of spring 80 engages left-handed safety groove 24 as illustrated in FIG. 7A. In order to disengage safety 10 so that pistol 2 is capable of firing, the trigger finger of the user pushes plug 20 to the left so that plug 20 does not protrude from trigger envelope as illustrated in FIG. 3A.

If the user is left-handed, plug 20 is configured with left-handed surface 32 positioned to engage detent end 84 of spring 80 as illustrated in FIG. 4B. In the safe position, detent end 84 of spring 80 engages right-handed safety groove 34. In order to disengage safety 10, the trigger finger of the user pushes the plug 20 to the right so that plug 20 does not protrude from trigger envelope; as a result, detent end 84 of spring 80 engages left-handed fire groove 38 as illustrated in FIG. 4A. Spring 80 resists movement of plug 20, not so much that plug 20 cannot be moved but enough so that it is not moved by slight, inadvertent pressure.

It will be apparent to those skilled in the art that many changes and substitutions can be made to the preferred embodiment herein described without departing from the spirit and scope of the present invention.

What is claimed is:

1. A trigger safety for a pistol fired by movement of a trigger finger, said trigger safety comprising:

a trigger; and preventing means carried by said trigger for preventing movement of said trigger, said preventing means having a fire position and a safe position and being movable between said fire position and said safe position, said preventing means preventing movement of said trigger when in said safe position, said preventing means including a plug being movable between said fire position and said safe position, said plug interfering with movement of said trigger when in said safe position and not interfering with movement of said trigger when in said fire position, said plug having a fire groove and a safe groove; and a spring for engaging said fire groove when said plug is in said fire position and engaging said safe groove when said plug is in said safe position wherein said spring resists movement of said plug between said fire position and said safe position so that said plug tends to stay in said fire position when moved to said fire position and tends to stay in said safe position when moved to said safe position.

2. The trigger safety as recited in claim 1, wherein said preventing means is movable between said fire position and said safe position with said trigger finger when holding said pistol.

3. The trigger safety as recited in claim 1, wherein said trigger is moved by said trigger finger in a first direction to fire said pistol and wherein said preventing means is moved by said trigger finger in a second direction orthogonal to said first direction when moving between said fire position and said safe position.

4. The trigger safety as recited in claim 1, wherein said plug engages the frame of the pistol to prevent movement of said trigger.

5. The trigger safety as recited in claim 1, wherein said plug has a first surface and a second surface wherein said second surface is orthogonal to said first surface; and said spring engages said first surface if configured for a right-handed user and engages said second surface if configured for a left-handed user.

6. A trigger safety for a pistol fired by movement of a trigger finger, said trigger safety comprising:

a trigger having an aperture therethrough, said trigger defining an envelope;

a plug carried within said aperture, said plug capable of moving between a fire position wherein said plug lies within said envelope and a safety position wherein said plug extends outside said envelope, said plug interfering with movement of said trigger when in said safe position and not interfering with movement of said trigger when in said fire position; and means for resisting movement of said plug between said fire position and said safe position so that said plug tends to stay in said fire position when moved to said fire position and tends to stay in said safe position when moved to said safe position, wherein said plug is movable between said fire position and said safe position with said trigger finger when holding said pistol.

7. The trigger safety as recited in claim 6, wherein said trigger is moved by said trigger finger in a first direction to fire said pistol and wherein said plug is moved by said trigger finger in a second direction orthogonal to said first direction when moving between said fire position and said safe position.

8. A pistol, comprising:

a frame;

a barrel carried by said frame;

a handle attached to said frame and grippable with one hand;

means carried within said frame for firing a bullet through said barrel and from said pistol;

a trigger in operative connection with said firing means, said firing means activated by movement of said trigger, said trigger having a hole formed therein;

a plug dimensioned to fit into said hole and slidable therein, said plug having a fire position and a safe position and being movable therebetween, said plug interfering with movement of said trigger when in said safe position and not interfering with movement of said trigger when in said fire position, wherein said plug, when in said safe position, engages said frame to prevent movement of said trigger; and a spring for resisting movement of said plug so that said plug tends to remain in said safe position when moved to said safe position and tends to remain in said fire position when moved to said fire position.

9. The trigger safety as recited in claim 8, wherein said plug is movable between said fire position and said safe position with said trigger finger when holding said pistol.

10. The trigger safety as recited in claim 8, wherein said trigger is moved by said trigger finger in a first direction to fire said pistol and wherein said plug is moved by said trigger finger in a second direction orthogonal to said first direction when moving between said fire position and said safe position.

11. The trigger safety as recited in claim 8, wherein said plug has a fire groove and a safe groove and wherein said spring engages said fire groove when said plug is in said fire position and engages said safe groove when said plug is in said safe position.

12. The trigger safety as recited in claim 8, wherein said plug has a first surface and a second surface wherein said second surface is orthogonal to said first surface and wherein said spring engages said first surface if configured for a right-handed user and engages said second surface if configured for a left-handed user.

13. The pistol as recited in claim 8, wherein said pistol is a double-action type pistol.

* * * * *

UNITED STATES PATENT AND TRADEMARK OFFICE

CERTIFICATE OF CORRECTION

PATENT NO. : 6,223,460 B1
APPLICATION NO. : 09/299777
DATED : May 1, 2001
INVENTOR(S) : Edward P. Schmitter et al.

It is certified that error appears in the above-identified patent and that said Letters Patent is hereby corrected as shown below:

Title Page, Insert, Item (73)
Assignee: FN Manufacturing, Inc. Columbia, SC

Signed and Sealed this

Twenty-second Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 6,223,460 B1
APPLICATION NO. : 09/299777
DATED : May 1, 2001
INVENTOR(S) : Edward P. Schmitter et al.

It is certified that error appears in the above-identified patent and that said Letters Patent is hereby corrected as shown below:

Title Page, Insert Item (73)
Assignee: FN Manufacturing, Inc. Columbia, SC

Signed and Sealed this

Twelfth Day of August, 2008

JON W. DUDAS
*Director of the United States Patent and Trademark Office*